US012441507B2

(12) United States Patent
Castle

(10) Patent No.: US 12,441,507 B2
(45) Date of Patent: Oct. 14, 2025

(54) SKIP SLOT BOX BLANKS, BOXES AND METHODS OF FORMING THE SAME

(71) Applicant: Georgia-Pacific Corrugated LLC, Atlanta, GA (US)

(72) Inventor: Matthew David Castle, Chillicothe, OH (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 83 days.

(21) Appl. No.: 18/371,470

(22) Filed: Sep. 22, 2023

(65) Prior Publication Data

US 2024/0101302 A1 Mar. 28, 2024

Related U.S. Application Data

(60) Provisional application No. 63/409,902, filed on Sep. 26, 2022.

(51) Int. Cl.
*B65D 5/42* (2006.01)

(52) U.S. Cl.
CPC ..... *B65D 5/4266* (2013.01); *B65D 5/4279* (2013.01)

(58) Field of Classification Search
CPC ..... B65D 5/4266; B65D 5/4279; B65D 2571/00592; B65D 2571/00753; B65D 2571/00839; B65D 5/443
USPC ..... 229/100, 125, 150, 122.32, 126, 132, 229/155, 225, 237, 930
See application file for complete search history.

(56) References Cited

U.S. PATENT DOCUMENTS

| | | | | |
|---|---|---|---|---|
| 2,718,998 | A * | 9/1955 | Bemiss | B65D 5/305 229/930 |
| 3,098,600 | A * | 7/1963 | Hagan | B65D 5/0227 229/920 |
| 2003/0116615 | A1* | 6/2003 | Hyatt | B65D 5/029 229/183 |
| 2007/0267466 | A1* | 11/2007 | Brand | B65D 5/0005 229/101 |
| 2018/0208350 | A1* | 7/2018 | Ertmer | B65D 5/0005 |

* cited by examiner

*Primary Examiner* — Christopher R Demeree

(57) ABSTRACT

Box blanks, boxes, and corresponding methods of forming the same are provided herein. The box blank comprises a plurality of panels and flaps. Each of the plurality of panels are connected along a foldable panel score line portion, and each of the plurality of flaps are connected along a foldable flap score line portion. The plurality of flaps are connected to the plurality of panels. The box blank further comprises a first cross-cut and a second cross-cut spaced apart from the first cross-cut to define an uncut portion therebetween. Each cross-cut extends across the flap score line portion. The box blank further comprises a first cut extending from the first cross-cut at least a portion of a distance to the plurality of panels, and a second cut extending from the second cross-cut at least a portion of a second distance leading towards an edge of the plurality of flaps.

21 Claims, 13 Drawing Sheets

SKIP SLOT BOX BLANKS, BOXES AND METHODS OF FORMING THE SAME

CROSS-REFERENCE TO RELATED APPLICATION(S)

This application claims priority to U.S. Provisional Application No. 63/409,902, entitled "Skip Slot Box Blanks, Boxes and Methods of Forming the Same", filed Sep. 26, 2022; the contents of which is incorporated by reference herein in its entirety.

BACKGROUND

Corrugate box blanks may be formed from a web of corrugate that may be formed in, for example, a corrugator. The box blank comprises various cuts, cut outs, scores and compressions increasing the ease of folding and erecting a box therefrom. The box blank may include thinning of areas including creases, slits, compressions, perforations, and cuts. A box may be assembled by a user or with a box maker (e.g., a case erector).

The box blank may be formed with a die cut positioned on a machine (e.g., a die cutting press). A user assembles the die cut onto the press and may be required to set up additional features needed for the die cut, including any knives, pins, and patterns that are unable to stay on the die cut. The time spent assembling and dissembling the die cut from the press may reduce the amount of available run time, and thus reduce the efficiency of the die cutting press. Additionally, when the die cut pattern requires holes in the corrugate box blank, the scrap corrugate resulting from the cut may remain in the die cut or press itself rather than being ejected. The un-ejected scrap corrugate must be manually removed, and adjustments may need to be made to the die cut, thereby increasing down time. Further, in addition to assembly and disassembly, any down time to repair or adjust the die cuts (e.g., due to scrap corrugate) may reduce efficiency. Thus, there is a need for a box blank which may be produced at a high efficiency and may reduce the amount of down time needed on the press when forming the box blank.

BRIEF SUMMARY

Embodiments of the present invention are directed to corrugate box blanks that are designed to reduce the amount of scrap corrugate, and reduce downtime of the die cutting press, and therefore increase efficiency and throughput. Importantly, rather than include multiple cut outs within the box blank, the box blank includes a plurality of scores that may be arranged in score lines (which may be referred to as, for example, crease lines, lines of weakness, etc.) and/or cuts arranged so the box blank is pliable, while not creating scrap of corrugate material. Thus, when the corrugate box blank is erected into a box, the resulting box flaps are secured to one another along the outer surface of the walls to secure the flaps in an open configuration, while allowing a user to easily position the flaps into a closed position after filling the box. Such box blanks, as noted above, are produced without certain scrap—thereby enabling them to be formed in high throughput presses and, in some cases, even in a 2-up scheme (e.g., two box blanks may be formed from a single rotation of a die cut).

In this regard, embodiments of the present invention are directed towards a box blank comprising a series of cross cuts, and parallel cuts, to afford easy manufacturing of boxes, while creating less scrap, and thus, improving efficiency and productivity. Some embodiments of the present invention are directed to corresponding boxes and methods for forming the box blanks and boxes.

In an example embodiment a box blank for a corrugated box is provided. The box blank comprises a plurality of panels including at least a first panel and a second panel. The first panel defines a first edge, a second edge, a third edge, and a fourth edge, and the second panel defines a first edge, a second edge, a third edge, and a fourth edge. The third edge of the first panel is connected to the first edge of the second panel along a panel score line portion, and the panel score line portion is foldable. The box blank further comprises a plurality of flaps including at least a first flap and a second flap. The first flap defines a first edge, a second edge, a third edge, and a fourth edge, and the second flap defines a first edge, a second edge, a third edge, and a fourth edge. The second edge of the first flap is connected to the fourth edge of the first panel, and the second edge of the second flap is connected to the fourth edge of the second panel. The third edge of first flap is connected to the first edge of the second flap along a flap score line portion, and the flap score line portion is foldable. The box blank further comprises a first cross-cut extending across the flap score line portion between the first flap and the second flap, and a second cross-cut extending across the flap score line portion between the first flap and the second flap. The second cross-cut is spaced apart from the first cross cut so as to define an uncut portion of the flap score line portion therebetween. The box blank further comprises a first cut extending from the first cross-cut at least a portion of a first distance leading to the fourth edge of the first flap or the fourth edge of the second flap, and a second cut extending from the second cross-cut at least a portion of a second distance leading to the second edge of the first flap or the second edge of the second flap.

In some embodiments, the second cut may comprise a tail portion and the tail portion may extend beyond the fourth edge of either the first panel or the second panel. In some embodiments, the tail portion may extend away from the panel score line portion. In some embodiments, the first cut may extend to the fourth edge of the first flap or the fourth edge of the second flap. In some embodiments, the uncut portion may be between 1-1.5 inches. In some embodiments, the flap score line may be a line of weakness. In some embodiments, the second cut may be parallel to the flap score line portion.

In some embodiments, the first cross-cut and the second cross-cut may extend non-linearly across the flap score line portion. In some embodiments, the first cross-cut of the second cross-cut may comprise a first portion extending in a first direction from the flap score line portion and a second portion extending in a second direction from the flap score line portion. In some embodiments, the first direction and the second direction may be different.

In some embodiments, the box blank may further comprise a panel pattern cut about the panel score line portion between the first panel and the second panel. In some embodiments, the panel pattern cut may comprise a first panel score line cross-cut extending across the panel score line portion between the first panel and the second panel, and a second panel score line cross-cut extending across the panel score line portion between the first panel and the second panel. In some embodiments, the second panel score line cross-cut may be spaced apart a distance from the first panel cross-cut. In some embodiments, the panel pattern cut may further comprise at least one panel cut or line of weakness extending at least partially between the first panel cross-cut and the second panel cross-cut. In some embodiments, the at least one panel cut or line of weakness is spaced apart from the panel score line between the first panel and the second panel. In some embodiments, the length of the uncut portion may be smaller than the distance between the first panel score line cross-cut and the second panel soccer line cross-cut.

In some embodiments, the box blank may further comprise a plurality of bottom flaps, including at least a first bottom flap and a second bottom flap. In some embodiments, the first bottom flap defines a first edge, a second edge, a third edge, and a fourth edge, and the second bottom flap defines a first edge, a second edge, a third edge, and a fourth edge. In some embodiments, the fourth edge of the first bottom flap is connected to the second edge of the first panel, and the fourth edge of the second bottom flap is connected to the second edge of the second panel. In some embodiments, the third edge of the first bottom flap may be spaced apart from the first edge of the second bottom flap.

In some embodiments, the first bottom flap and the second bottom flap may be foldable about a bottom score line. The bottom score line may abut the fourth edge of the first bottom flap and the fourth edge of the second bottom flap and the second edge of the first panel and the second edge of the second panel.

In some embodiments, the plurality of panels of the box blank may further comprise a third panel and a fourth panel. In some embodiments, the third panel defines a first edge, a second edge, a third edge, and a fourth edge. In some embodiments, the first edge of the third panel is connected to the third edge of the second panel along a second panel score line portion. In some embodiments, the fourth panel defines a first edge, a second edge, a third edge, and a fourth edge. In some embodiments, the third edge of the fourth panel is connected to the first edge of the first panel along a third panel score line portion. In some embodiments, the plurality of flaps of the box blank may further comprise a third flap and a fourth flap. In some embodiments, the third flap defines a first edge, a second edge, a third edge, and a fourth edge, and the fourth flap defines a first edge, a second edge, a third edge, and a fourth edge. In some embodiments, the second edge of the third flap is connected to the fourth edge of the third panel, and the second edge of the fourth flap is connected to the fourth edge of the fourth panel. In some embodiments, the first edge of the third flap is connected to the third edge of the second flap along a second flap score line portion, and the second flap score line portion may be foldable. In some embodiments, the first edge of first flap is connected to the third edge of the fourth flap along a third flap score line portion, and the third flap score line portion may be foldable.

In some embodiments, the box blank may further comprise a connector tab comprising at least a connector panel, connected to either the third side of the third panel or the first side of the fourth panel along a fourth panel score line portion. In some embodiments, the connector tab may further comprise a connector flap connected to either the third side of the third flap or the first side of the fourth flap along a fourth flap score line portion. In some embodiments, the box blank may further comprise a third cross-cut extending across the fourth flap score line portion, and a fourth cross-cut extending across the fourth flap score line portion. In some embodiments, the fourth cross-cut may be spaced apart from the third cross-cut so as to define a second uncut portion of the fourth flap score line therebetween. In some embodiments, the box blank may further comprise a third cut extending from the third cross-cut at least a portion of a first distance leading to the fourth edge of the third flap or the fourth edge of the fourth flap, and a fourth cross-cut extending from the fourth cross-cut at least a portion of a second distance leading to the second edge of the third flap or the second edge of the fourth flap.

In some embodiments, the box blank may further comprise a third bottom flap and a fourth bottom flap. In some embodiments, the third bottom flap defines a first edge, a second edge, a third edge, and a fourth edge, and the fourth bottom flap defines a first edge, a second edge, a third edge, and a fourth edge. In some embodiments, the fourth edge of the third bottom flap is connected to the second edge of the third panel, and the fourth edge of the fourth bottom flap is connected to the second edge of the fourth panel. In some embodiments, the first edge of the third bottom flap is spaced apart from the third edge of the second bottom flap, and the third edge of the third bottom flap is spaced apart from the first edge of the second bottom flap.

In another example embodiment of the present invention a method of forming a box is provided. The method comprises providing a blank. The blank comprises a sheet of corrugate defining a first outer edge, a second outer edge, a third outer edge and a fourth outer edge. The fourth outer edge is parallel to the second outer edge, and the fourth outer edge is perpendicular to the first outer edge, and the first outer edge is parallel to the third outer edge.

The method further comprises running the blank through a blank die to form a box blank. The box blank comprises a plurality of panels including at least a first panel and a second panel. The first panel defines a first edge, a second edge, a third edge, and a fourth edge, and the second panel defines a first edge, a second edge, a third edge, and a fourth edge. The third edge of the first panel is connected to the first edge of the second panel along a panel score line portion, and the panel score line portion is foldable. The box blank further comprises a plurality of flaps including at least a first flap and a second flap. The first flap defines a first edge, a second edge, a third edge, and a fourth edge, and the second flap defines a first edge, a second edge, a third edge, and a fourth edge. The second edge of the first flap is connected to the fourth edge of the first panel, and the second edge of the second flap is connected to the fourth edge of the second panel. The third edge of first flap is connected to the first edge of the second flap along a flap score line portion, and the flap score line portion is foldable. The box blank further comprises a connection tab extending from one of the plurality of panels and a corresponding one of the plurality of flaps. The connection tab is defined by a connection tab score line. The box blank further comprises a first cross-cut extending across the flap score line between the first flap and the second flap, and a second cross-cut extending across the flap score line between the first flap and the second flap. The second cross-cut is spaced apart from the first cross cut so as to define an uncut portion of the flap score line portion therebetween. The box blank further comprises a first cut extending from the first cross-cut at least a portion of a first distance leading to the fourth edge of the first flap or the fourth edge of the second flap, and a second cut extending from the second cross-cut at least a portion of a second distance leading to the second edge of the first flap or the second edge of the second flap.

The method further comprises providing the box blank to a box maker. The box maker is configured to fold the plurality of flaps such that an outer surface of the plurality of flaps abuts an outer surface of the plurality of panels. The box make is further configured to fold the plurality of panels along the plurality of panel score line portions. The box maker is further configured to adhere the connection tab to one of the plurality of panels and the corresponding one of the plurality of flaps, and adhere the plurality of bottom flaps to form a bottom surface.

In some embodiments, the blank die may be configured to penetrate a thickness of the blank without removing material from the blank.

In yet another example embodiment a box formed from a corrugated box blank is provided. In some embodiments, the box comprises a plurality of walls including at least a first wall, a second wall, a third wall, and a fourth wall, wherein each wall is connected to the adjacent wall at a foldable score line portion. In some embodiments, the box comprises a plurality of flaps, including at least a first flap, a second flap, a third flap and a fourth flap. Each of the plurality of flaps extend from the corresponding wall of the plurality of walls, and each of the plurality of flaps are folded such that at least a portion of an outer surface of the plurality of walls abuts at least a portion of an outer surface of the plurality of flaps. The plurality of flaps comprises a first uncut portion between the first flap and a second flap and a second uncut portion between the third flap and the fourth flap. The box further comprises a plurality of bottom flaps. Each of the plurality of bottom flaps extend from the plurality of walls opposite the plurality of walls, and the plurality of bottom flaps are adhered to form a bottom, wherein the bottom is perpendicular to the plurality of walls. The box further comprises a connector tab extends from either the first wall and the first flap or the fourth wall and the fourth flap. The connector tab is adhered to either the first wall and the first flap or the fourth wall and the fourth flap.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4A:
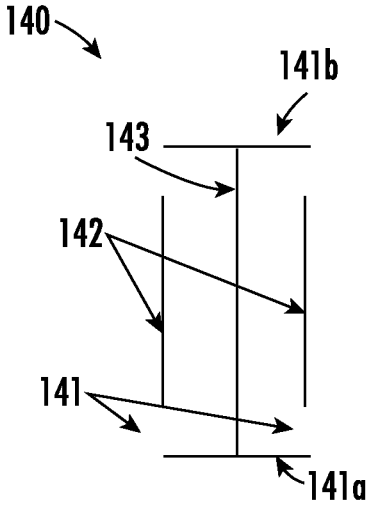
Figure 4B:
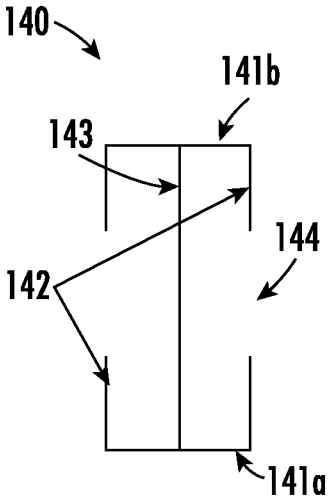
Figure 4C:
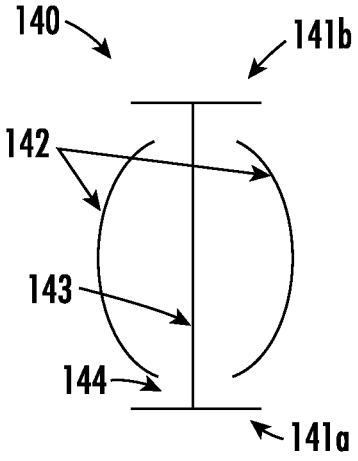
Figure 5A:
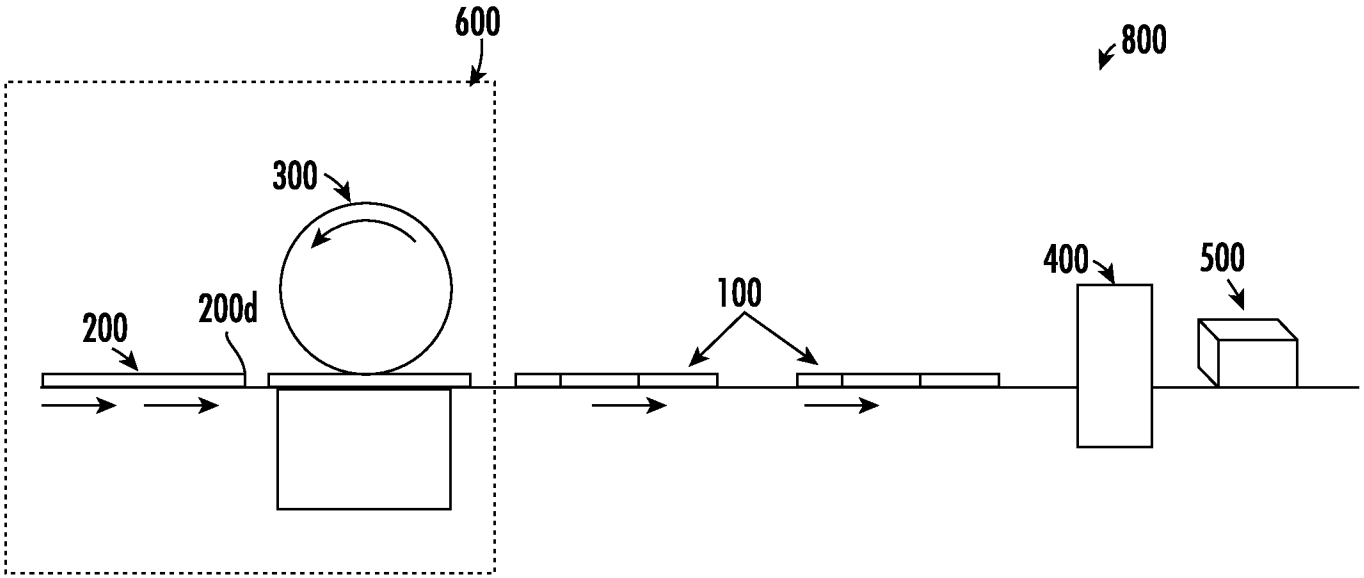
Figure 5B:
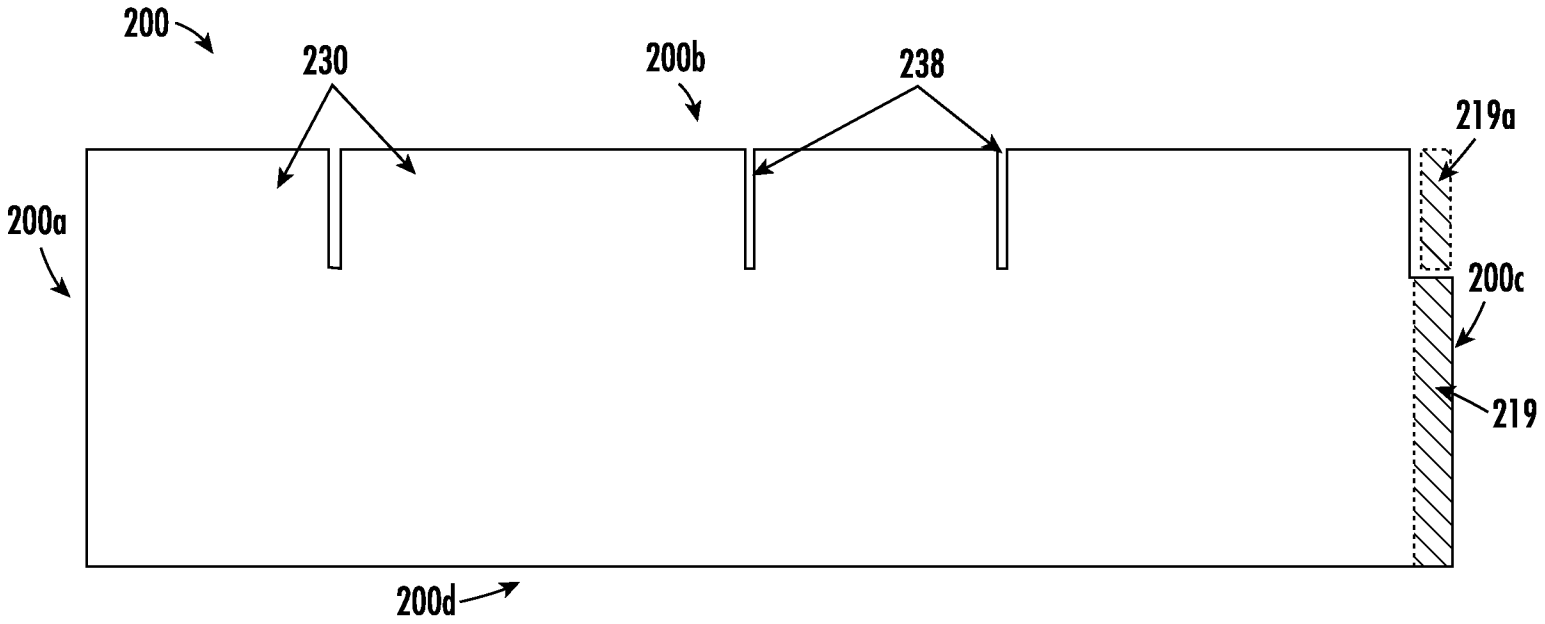
Figure 5C:
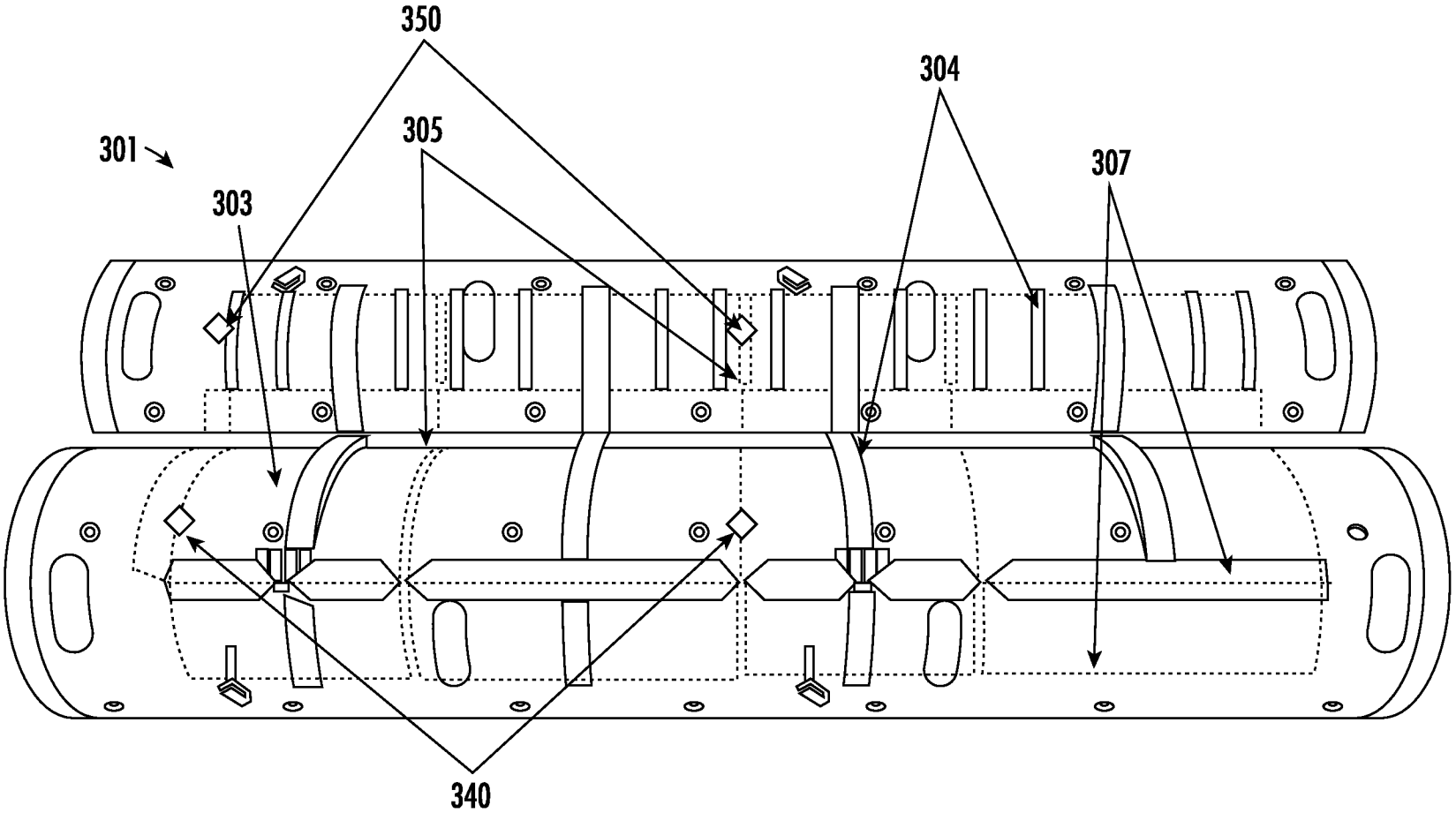
Figure 5D:
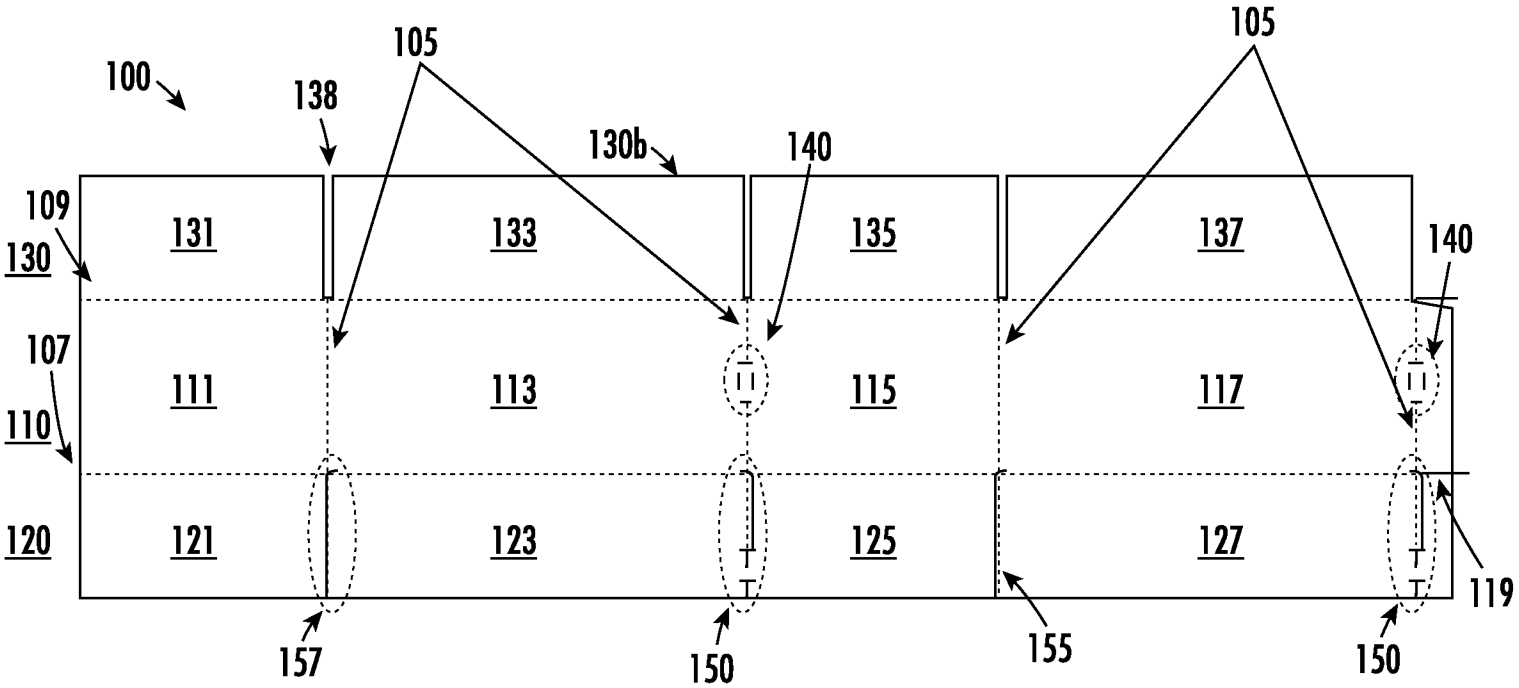
Figure 6A:
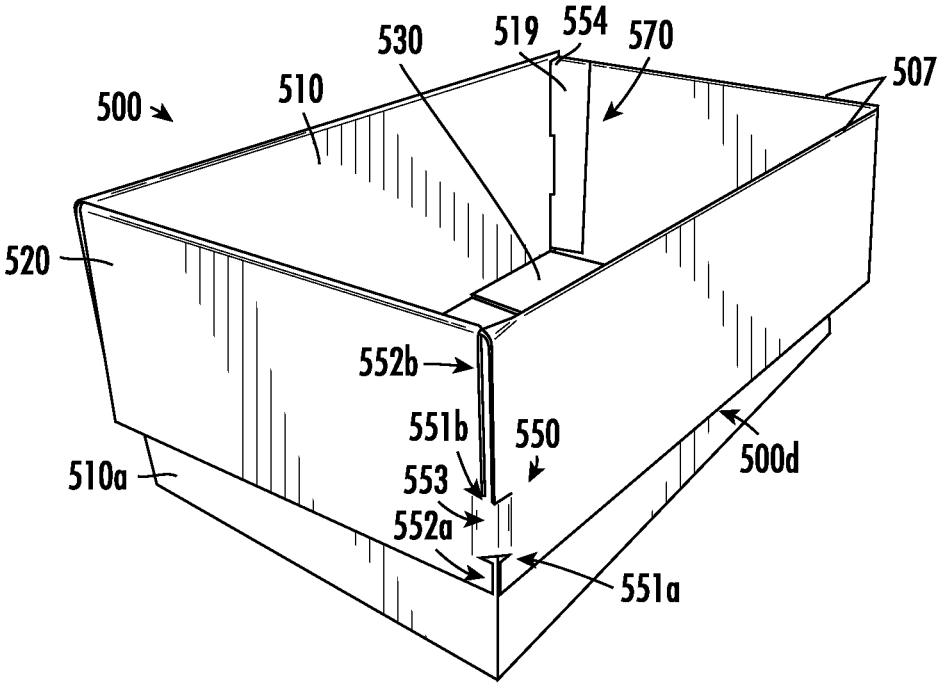
Figure 6B:
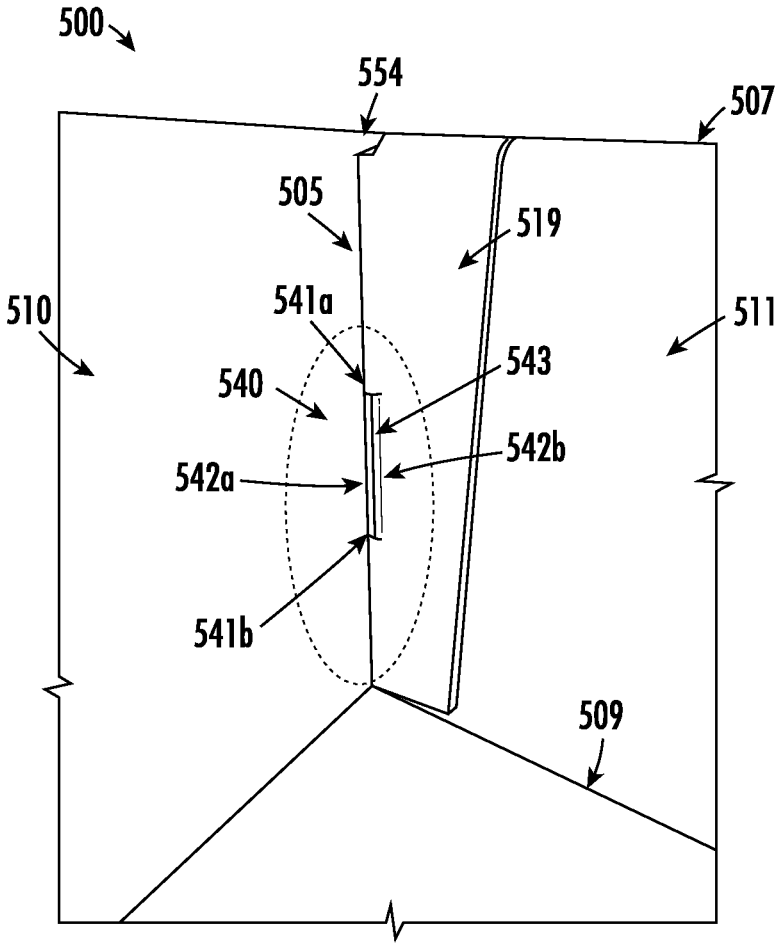
Figure 7:
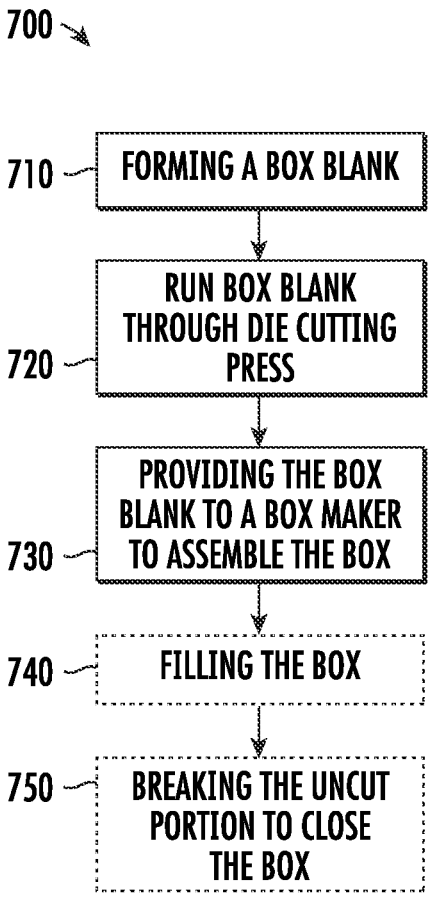

FIGS. 4A-C illustrate various configurations of example pattern cuts, in accordance with some embodiments discussed herein;

FIG. 5A illustrates an example process of forming an example box, in accordance with some embodiments discussed herein;

FIG. 5B illustrates an example corrugate sheet, in accordance with some embodiments discussed herein;

FIG. 5C illustrates an example die cut, in accordance with some embodiments discussed herein;

FIG. 5D illustrates an example box blank formed from the example die cut, in accordance with some embodiments discussed herein;

FIG. 6A is a perspective view of an example box, formed from the example box blank shown in FIG. 1, in accordance with some embodiments discussed herein;

FIG. 6B is a close-up view of an interior portion of the example box shown in FIG. 6A, in accordance with some embodiments discussed herein; and FIG. 7 illustrates a flowchart of an example method of forming a blank, and forming a box from the blank, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

Notably, while some embodiments describe various positional qualifiers for various features, such as "top", "bottom", "front", "back", "side", etc. embodiments described herein are not meant to be limited to such qualifiers unless otherwise stated. Directional qualifiers herein are generally used to aid in describing the invention in the context of the drawings and/or description but are not otherwise intended to be limiting.

While some embodiments describe a "user", use of such a term herein is not meant to be limited to a person or a single person, as the "user" may be an end user, a consumer, a manufacturer, among other types of users along a supply chain in relation to the box design. Further, when utilizing the word "user", the actor(s) may be operating one or more machines/system that cause the intended function (e.g., forming the box blank or converting the box blank to a box).

Figure 1A:
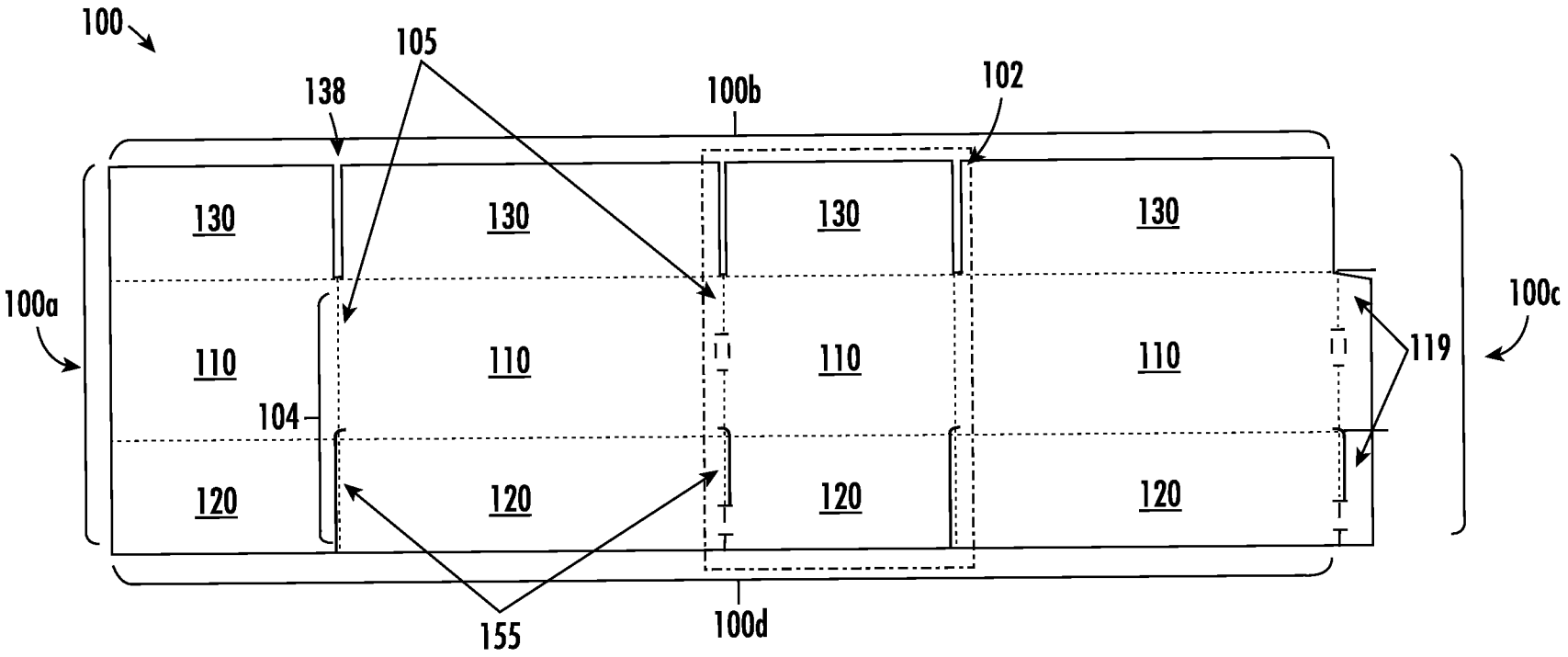
FIG. 1A illustrates an example corrugated box blank, in accordance with some embodiments discussed herein.

An example box blank 100 is shown in FIG. 1A. With reference to FIGS. 1A-2B, the corrugated box blank 100 is formed of a plurality of panels 110, a plurality of flaps 120, and a plurality of bottom flaps 130 and a connector tab 119. The box blank 100 may comprise a first outer edge 100*a*, a second outer edge 100*b* (also referred to as a "trailing edge"), a third outer edge 100*c*, and a fourth outer edge 100*d* (also referred to as a "leading edge") defining an outer periphery of the box blank 100. In some embodiments, the fourth outer edge 100*d* may be parallel to the second outer edge 100*d* and may be perpendicular to both the first outer edge 100*a* and the third outer edge 100*c*. In some embodiments, the second outer edge 100*b* may comprise a plurality of gaps 138 such that in some embodiments the second outer edge 100*b* may not be continuous. Additionally, in some embodiments, the connector tab 119 may define a portion of the third outer edge 100*c* and may not extend from the fourth outer edge 100*d* to the second outer edge 100*b*. Thus, in some embodiments, the third outer edge 100*c* may comprise multiple sections.

Notably, in some embodiments, the box blank 100 may be processed through one or more manufacturing systems at various stages, such as described herein. For example, in some embodiments, the box blank 100 may be formed from a web of corrugated material which may be cut into the box blank 100, the box blank 100 may be further processed through a die cut to form desired cuts, scores, or impressions thereon, and/or the box blank 100 may be passed through a box maker to form the box therein. In this regard, use of the term leading edge versus trailing edge may relate to the machine direction in which the box blank passes. However, other edges may be a leading edge or a trailing edge.

Likewise, the leading edge and the trailing edge may be opposite than described in the illustrated embodiment.

In some embodiments, the box blank 100 may comprise multiple adjacent sections 102, each comprising one of the plurality of panels 110, one of the plurality of flaps 120 and one of the plurality of bottom flaps 130. In some embodiments, adjacent sections 102 may be connected via a section score line 104. In some embodiments, each section score line may comprise a panel score line portion 105 between adjacent panels and via a flap score line portion 155 between adjacent flaps. In this regard the section score line 104 may be continuous between the second outer edge 100*b* and the fourth outer edge 100*d*. In some embodiments, the term "score" may be used to describe a compression of the internal support system of the blank without creating a cut therethrough. In some embodiments, the sections 102 of the box blank 100 may be foldable about the section score line 104.

Figure 1B:
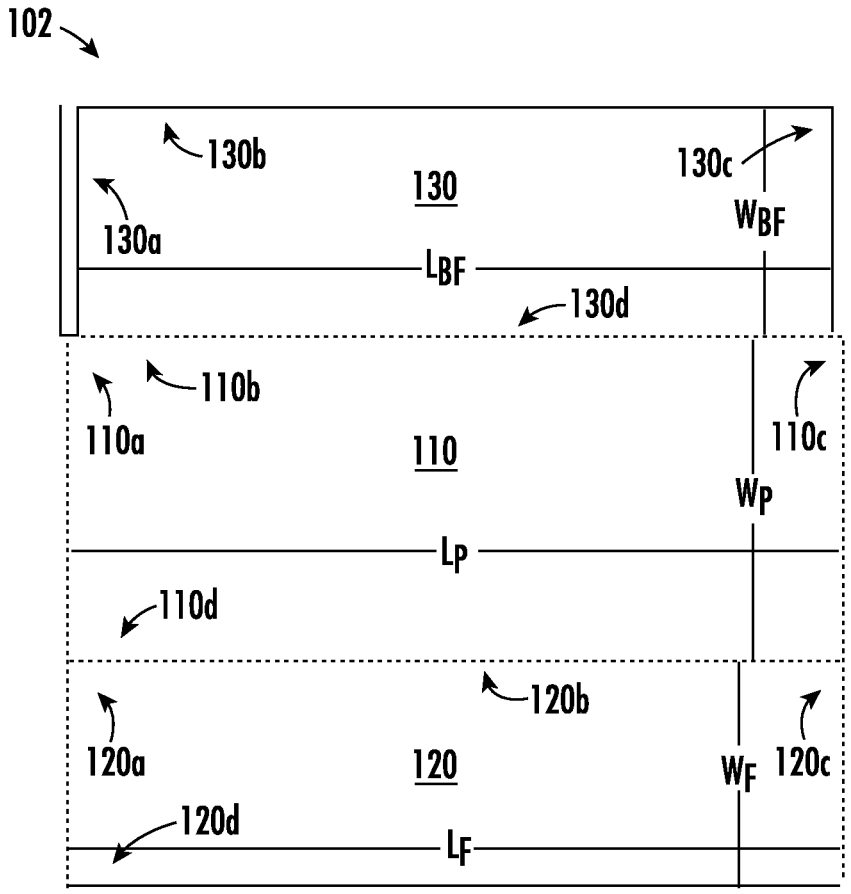
FIG. 1B illustrates an example section of the corrugated box blank shown in FIG. 1, in accordance with some embodiments discussed herein.

FIG. 1B illustrates an example section 102 of the box blank 100. Each section 102 of the box blank comprises one of the plurality of panels 110, one of the plurality of flaps 120 and one of the pluralities of bottom flaps 130. In some embodiments, each of the plurality of panels 110 comprises a first edge 110*a*, a second edge 110*b*, a third edge 110*c*, and a fourth edge 110*d*. In some embodiments, the first edge 110*a* and the third edge 110*c* are parallel, and the first edge 110*a* is perpendicular to each of the second edge 110*b* and the fourth edge 110*d*. Similarly, each of the plurality of flaps 120 comprises a first edge 120*a*, a second edge 120*b*, a third edge 120*c*, and a fourth edge 120*d*. In some embodiments, the first edge 120*a* and the third edge 120*c* are parallel, and the first edge 120*a* is perpendicular to each of the second edge 120*b* and the fourth edge 120*d*. Likewise, the plurality of bottom flaps 130 each comprise a first edge 130*a*, a second edge 130*b*, a third edge 130*c*, and a fourth edge 130*d* and the first edge 130*a* and the third edge 130*c* are parallel, while the first edge 130*a* is perpendicular to each of the second edge 130*b* and the fourth edge 130*d*.

As illustrated, the second edge 120*b* of one of the plurality of flaps 120 may extend from the fourth edge 110*d* of one of the plurality of panels 110. Similarly, the fourth edge 130*d* of one of the plurality of bottom flaps 130 may extend from the second edge 110*b* of one of the plurality of panels 110. Said differently the box blank 100 may comprise a continuous piece of corrugated material comprising a bottom flap, a panel and a flap.

In some embodiments, each of the plurality of panels 110 defines a panel length $L_P$, wherein the panel length $L_P$ extends between the first edge 110*a* and the third edge 110*c*. In some embodiments, the panel length $L_P$ is between 8-20 in, 9-19 in, or 10-18 in. In some embodiments, each of the plurality of panels 110 defines a panel width $W_P$ extending between the second edge 110*b* and the fourth edge 110*d* of the panel. In some embodiments, the panel width $W_P$ is between 5-10 in, between 6-9 in, or between 7-8 in. In some embodiments, each of the plurality of panels 110 defines the same panel width $W_P$. In some embodiments, each of the plurality of panels 110 defines the same panel length $L_P$, while in other embodiments the plurality of panels 110 may alternate panel lengths $L_P$. For example, in an example embodiment, adjacent panels may define different panel lengths $L_P$, while alternating panels may define the same panel lengths $L_P$.

In some embodiments, each of the plurality of flaps 120 defines a flap length $L_F$, wherein the flap length $L_F$ extends from the first edge 120*a* to the third edge 120*c*. In some embodiments, the flap length $L_F$ is between 8-20 in, 9-19 in, or 10-18 in. In some embodiments, the flap length $L_F$ is equal to the panel length $L_P$ of the corresponding panel of the plurality of panels 110. In some embodiments, each of the plurality of flaps 120 defines a flap width $W_F$, wherein the flap width $W_F$ extends between the second edge 120*b* and the fourth edge 120*d*. In some embodiments, the flap width $W_F$ is between 3-8 in, between 4-7 in, or between 5-6 in. In some embodiments, the flap width $W_F$ may be equal for the plurality of flaps 120, while the flap length $L_F$ may change across the plurality of flaps 120 corresponding to the panel length $L_P$ of the corresponding panel of the plurality of panels 110.

In some embodiments, each of the plurality of bottom flaps 130 defines a bottom flap length $L_{BF}$, wherein the bottom flap length $L_{BF}$ extends between the first edge 130*a* and the third edge 130*c*. In some embodiments, the bottom flap length $L_{BF}$ is between 8-20 in, 9-19 in, or 10-18 in. In some embodiments, the bottom flap length $L_{BF}$ is equal to the panel length $L_P$, while in other embodiment the bottom flap length $L_{BF}$ is smaller than the panel length $L_P$. In this regard, the gap 138 between the plurality of flaps 130 comprises the difference in length between the bottom flap length $L_{BF}$ and the panel length $L_P$. In some embodiments, the gap 138 is between 1/32-1/8 in, more particularly between 1/16-1/8 in, while in some embodiments, the gap 138 may be negligible.

In some embodiments, each of the plurality of bottom flaps 130 defines a bottom flap width $W_{BF}$, extending between the second edge 130*b* and the fourth edge 130*d*. In some embodiments, the bottom flap width $W_{BF}$ is between 3-8 in, between 4-7 in, or between 5-6 in. In some embodiments, each of the plurality of bottom flaps 130 defines an equal bottom flap width $W_{BF}$, while the bottom flap length $L_{BF}$ changes across the plurality of bottom flaps 130 corresponding to the panel length $L_P$ of the corresponding panel of the plurality of panels 110.

Figure 2A:
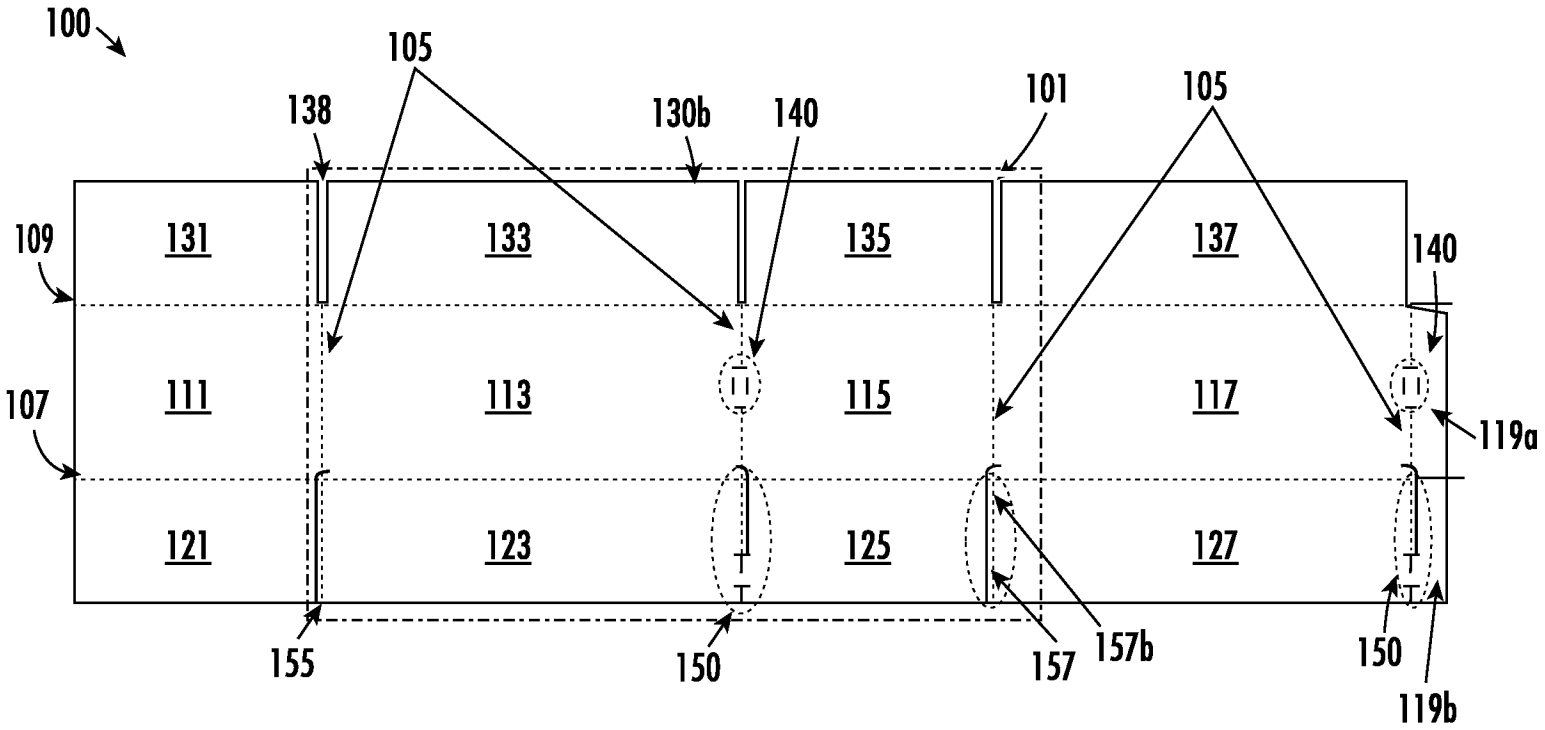
FIG. 2A illustrates an example corrugated box blank, in accordance with some embodiments discussed herein.

In some embodiments, such as illustrated in FIG. 2A, the plurality of panels 110 may comprise a first panel 113, a second panel 115, a third panel 117, and a fourth panel 111 (corresponding walls can be seen in the box form 500 illustrated in FIGS. 6A-B). In this regard, the term "panels" may be used when in a box blank form and the term "walls" may be used when in the erected/formed box form, although such differentiation in terminology is not required for an understanding of what is being described or claimed.

In some embodiments, each of the plurality of panels 110 are connected to one of the plurality of flaps 120 via a juncture score line 107 at the respective position. For example, the first panel 113 is connected to a first flap 123, the second panel 115 is connected to a second flap 125, the third panel 117 is connected to a third flap 127 and the fourth panel 111 is connected to a fourth flap 121. In this regard, the juncture score line 107 may be a single score line extending along the box blank 100, from the first outer edge (e.g., 100*a* FIG. 1A) to the third outer edge (e.g., 100*c* FIG. 1A). In some embodiments, the plurality of panels 110 and the plurality of flaps 120 are foldable about the juncture score line 107.

In some embodiments, the plurality of panels 110 are connected to the plurality of bottom flaps 130 via a bottom score line 109. For example, the first panel 113 is connected to a first bottom flap 133, the second panel 115 is connected to a second bottom flap 135, the third panel 117 is connected to a third bottom flap 137, and the fourth panel 111 is connected to a fourth bottom flap 131. In some embodiments, the plurality of panels 110 and the plurality of bottom flaps 130 are foldable about the bottom score line 109. In this regard the bottom score line 109 may be one continuous score extending across the box blank 100, from the first outer edge (e.g., 100*a* FIG. 1A) to the third outer edge (e.g., 100*c* FIG. 1A).

In some embodiments, one or more of the panel score line portions 105 may comprise a panel pattern cut 140, disposed about the panel score line portion 105 and the adjacent panels. For example, in the illustrated embodiment the panel pattern cut 140 may extend between the first panel 113 and the second panel 115 and may be bound between the juncture score line 107 and the bottom score line 109. Additionally, another panel pattern cut 140 may extend between the third panel 117 and a connector first portion 119*a*. Notably, the connector tab 119 may, thus, be formed of one or more sections, such as the connector first portion 119*a* (e.g., a connector panel) and/or a connector second portion 119*b* (e.g., a connector flap). In some embodiments, the connector tab 119 may extend from one of the plurality of panels 110, and/or one of the plurality of flaps 120 (e.g., the fourth panel 111 and/or the fourth flap 121). In this regard, in some embodiments the connector tab 119 only extends from one of the plurality of panels 110; in some embodiments the connector tab 119 only extends from one of the plurality of flaps 120; and in other embodiments the connector tab 119 extends from both the one of the plurality of panels 110 and one of the plurality of flaps 120. Further, in some embodiments, the connector tab 119 may optionally extend from one of the plurality of bottom flaps 130.

In some embodiments, the flap score line portion 155 may comprise a cut, perforations, line of weakness, compression and/or other weakness. In some embodiments, the flap score line portion 155 extending between adjacent flaps may comprise different configurations depending on the placement of the flap score line portion 155. For example, the flap score line portion 155 may define a flap pattern cut 150 when positioned along the score defining a panel pattern cut 140, while the flap score line portion 155 extending from a panel score line portion 105 without a panel pattern cut 140 (e.g., between the second panel 115 and the third panel 117) may define a flap score line cut 157 adjacent to or in conjunction with the flap score line portion 155. In some embodiments, the flap score line cut 157 may be formed by a box maker, rather than with the die cut, such as the case erector 400 shown and described with respect to FIG. 5A.

In some embodiments, each of the plurality of bottom flaps 130 may be separated by the bottom gap 138 extending from the second outer edge (e.g., 100*b* FIG. 1A) of the box blank 100 to the juncture score line 107. In some embodiments, each gap 138 may be cut out of the corrugate material (e.g., sheet or web) prior to die cutting. In some embodiments, each gap 138 may be a cut between adjacent flaps of the plurality of bottom flaps 130.

Figure 2B:
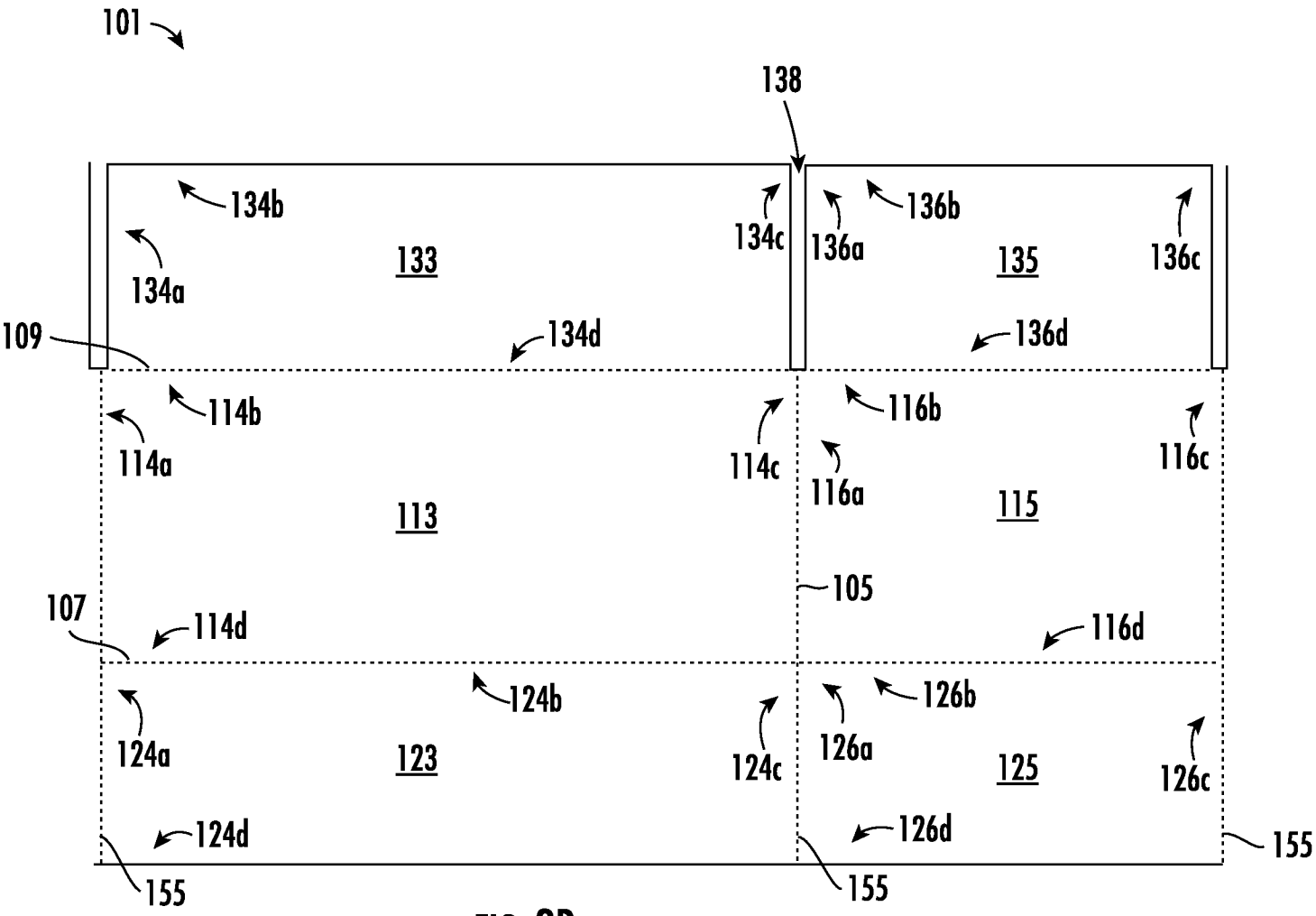
FIG. 2B illustrates a portion of the corrugated box blank shown in FIG. 2A, in accordance with some embodiments discussed herein

FIG. 2B illustrates a portion 101 of the box blank 100 illustrated in FIG. 2A. In some embodiments, the portion 101 may comprise the first panel 113 and the second panel 115. In some embodiments, the first panel 113 may comprise a first edge 114*a*, a second edge 114*b*, a third edge 114*c*, and a fourth edge 114*d*. In some embodiments, the first edge 114*a* and the third edge 114*c* may be parallel, and the first edge 114*a* may be perpendicular to each of the second edge 114*b* and the fourth edge 114*d*.

In some embodiments, the second panel 115 may comprise a first edge 116*a*, a second edge 116*b*, a third edge 116*c* and a fourth edge 116*d*. In some embodiments, the first edge 116*a* and the third edge 116*c* may be parallel, and the first edge 116*a* may be perpendicular to each of the second edge 116*b* and the fourth edge 116*d*. In some embodiments, the third edge 114*c* of the first panel 113 may be connected to the first edge 116*a* of the second panel 115 at the panel score line portion 105. In some embodiments, the panel score line portion 105 may be foldable. In some embodiments, the panel score line portion 105 may be configured as a compression within the corrugate material.

In some embodiments, the portion 101 of the box blank 100 may comprise a first flap 123, and a second flap 125. In some embodiments, the first flap 123 may define a first edge 124*a*, a second edge 124*b*, a third edge 124*c*, and a fourth edge 124*d*. In some embodiments, the first edge 124*a* may be parallel to the third edge 124*c*, and the first edge 124*a* may be perpendicular to both the second edge 124*b* and the fourth edge 124*d*. In some embodiments, the second flap 125 may define a first edge 126*a*, a second edge 126*b*, a third edge 126*c*, and a fourth edge 126*d*. In some embodiments, the first edge 126*a* may be parallel to the third edge 126*c*, and the first edge 126*a* may be perpendicular to both the second edge 126*b* and the fourth edge 126*d*. In some embodiments, the fourth edge 124*d* of the first flap 123 and the fourth edge 126*d* of the second flap 125 define the fourth outer edge (e.g., 100*d* FIG. 1A) of the box blank (e.g., 100 FIG. 1A).

In some embodiments, the third edge 124*c* of the first flap 123 and the first edge 126*a* of the second flap 125 may be connected along the flap score line portion 155. In some embodiments, the flap score line portion 155 may be foldable, while in other embodiments the flap score line portion 155 may further define a cut, a line of weakness, perforations, or other similar feature.

As discussed, in some embodiments, the second edge 124*b* of the first flap 123 may be connected to the fourth edge 114*d* of the first panel 113 along the juncture score line 107. Similarly, the second edge 126*b* of the second flap 124 may be connected to the fourth edge 116*d* of the second panel 115 along the juncture score line 107. In some embodiments, the first flap 123 and the second flap 125 may be foldable along the juncture score line 107. In some embodiments, the juncture score line 107 may be configured such that the first flap 123 and the second flap 125 may be foldable.

In some embodiments, the plurality of bottom flaps 130 may comprise at least a first bottom flap 133 and a second bottom flap 135. The first bottom flap 133 may comprise a first edge 134*a*, a second edge 134*b*, a third edge 134*c*, and a fourth edge 134*d*. In some embodiments, the first edge 134*a* may be parallel to the third edge 134*c*, and the first edge 134*a* may be perpendicular to both the second edge 134*b* and the fourth edge 134*d*. The second bottom flap 135 may comprise a first edge 136*a*, a second edge 136*b*, a third edge 136*c*, and a fourth edge 136*d*. In some embodiments, the first edge 136*a* may be parallel to the third edge 136*c*, and the first edge 136*a* may be perpendicular to both the second edge 136*b* and the fourth edge 136*d*.

In some embodiments, the fourth edge 134*d* of the first bottom flap 133 may be connected to the second edge 114*b* of the first panel 113 along the bottom score line 109. Similarly, the fourth edge 136*d* second bottom flap 135 may be connected to the second edge 116*b* of the second panel 115. In some embodiments, the second edge 134*b* of the first bottom flap 133 and the second edge 136*b* of the second bottom flap 135 may be considered as the second outer edge (e.g., 100*b* FIG. 1A) of the box blank (e.g., 100 FIG. 1).

Returning briefly to FIG. 2A, as discussed, the box blank 100 may comprise at least one flap pattern cut 150 and at least one panel pattern cut 140. In some embodiments, the number of flap pattern cuts 150, is equal to the number of panel pattern cuts 140. In some embodiments, there may be two flap pattern cuts 150, and two panel pattern cuts 140. In some embodiments, the box blank may include only one or more flap pattern cuts 150 and no panel pattern cuts 140. Alternatively, in some embodiments, the box blank may include only one or more panel pattern cuts 140 and no flap pattern cuts 150.

In some embodiments, with reference to FIG. 2A, the flap score line portion 155 may comprise the flap score line cut 157. In some embodiments, the flap score line cut 157 may extend from the leading edge (e.g., 100*d* FIG. 1A) of the box blank 100 into one of the plurality of panels 110. In some embodiments, the flap score line cut 157 may be parallel to the flap score line portion 155, while in other embodiments the flap score line cut 157 may be positioned within the flap score line portion 155. In this regard, the flap score line cut 157 may comprise a series of perforations, or points of weakness formed within the flap score line portion 155 such that the adjacent flaps may be easily separable. In some embodiments, the flap score line cut 157 may include an end portion 157*b* which may extend along the juncture score line 107, for example, as illustrated in FIG. 2A the end portion 157*b* extends into the third panel 117. In some embodiments, the end portion 157*b* may be parallel to the juncture score line 107, while in other embodiments, the end portion 157*b* may extend at an angle from the juncture score line 107.

As discussed above, the flap score line portions 155 may comprise a flap score line cut 157 or a flap pattern cut 150. FIGS. 3A-D illustrate configurations of example flap pattern cuts 150. In some embodiments, each of the flap pattern cuts 150 may extend in a corresponding manner with a flap score line portion 155. In some embodiments, the flap pattern cut 150 may be configured to interact with the panel pattern cut 140 when the box blank is formed into a box, while in other embodiments, the panel pattern cut 140 may be omitted.

In some embodiments, each flap pattern cut 150 may include a first cross-cut 151*a* and a spaced apart second cross-cut 151*b*, each extending across the flap score line portion (e.g., 155, FIG. 2A). In some embodiments, a first cut 152*a* may extend from the first cross-cut 151*a* towards the leading edge 100*d*. In some embodiments, the first cut 152*a* may extend from the first cross-cut 151*a* all the way to the leading edge 100*d*, while in other embodiments, the first cut 152*a* may end prior to reaching the leading edge 100*d*. In some embodiments, the first cut 152*a* may be along the flap score line portion 155, while in other embodiments, the first cut 152*a* may be parallel to, but spaced apart from the flap score line portion 155.

In some embodiments, a second cut 152*b* may extend from the second cross-cut 151*b* towards the juncture score line 107 between the plurality of flaps 120 and plurality of panels 110. In some embodiments, the second cut 152*b* may extend through the juncture score line 107, while in other embodiments, the second cut 152*b* may extend to the juncture score line 107. In some embodiments, the second cut 152*b* may be along the flap score line portion 155, while in other embodiments, as illustrated in FIG. 3C, the second cut 152*b* may be parallel to, but spaced apart from the flap score line portion 155. In some embodiments, the first cross-cut 151*a* and the second cross-cut 151*b* may define the same orientation and shape, while in other embodiments the first cross-cut 151*a* and the second cross-cut 151*b* may define different orientations and/or shapes (e.g., a linear cross-cut, and a non-linear cross-cut).

Figure 3A:
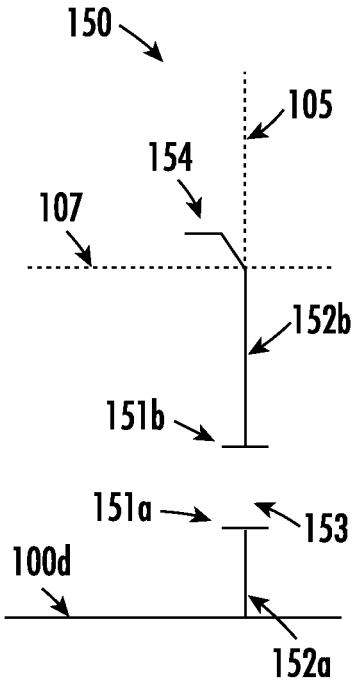
FIGS. 3A-D illustrate various configurations of example tab cuts, in accordance with some embodiments discussed herein.
Figure 3B:
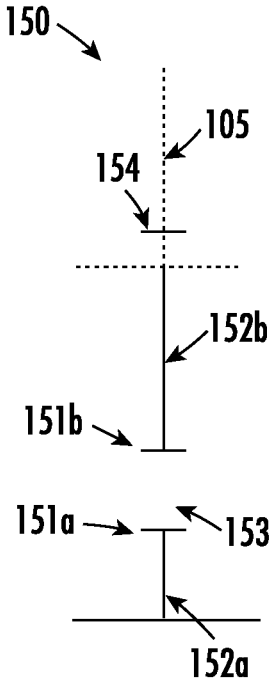
Figure 3C:
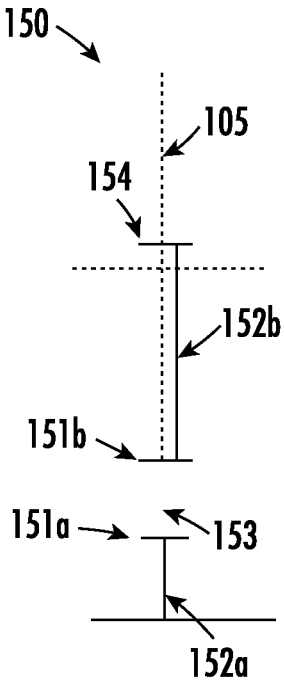
Figure 3D:
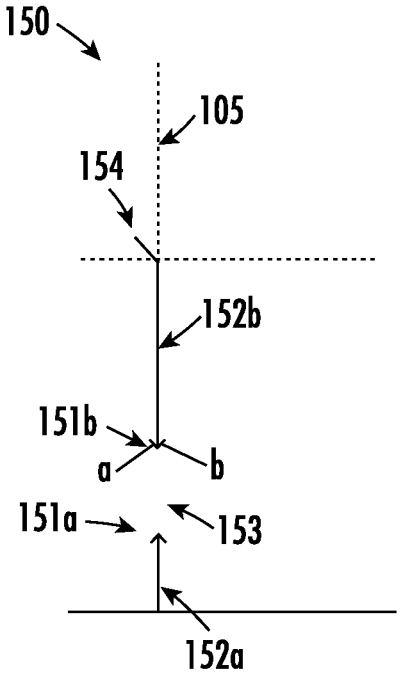

In some embodiments, such as illustrated in FIGS. 3A-C, the first cross-cut 151*a* and the second cross cut 151*b* may extend linearly across the flap score line portion (e.g., 155 FIG. 2A) between two of the plurality of flaps (e.g., the first flap 123 and the second flap 125 FIG. 2A), while in other embodiments, the first cross-cut 151*a* and the second cross-cut 151*b*, such as illustrated in FIG. 3D, may extend non linearly across the flap score line portion (e.g., 155 FIG. 2A) between two of the plurality of flaps (e.g., the first flap 123 and the second flap 125 FIG. 2A). To explain further, as illustrated in FIG. 3D the first cross-cut 151*a* and the second cross-cut 151*b* each contain a first portion (a) and a second portion (b) which are formed into an arrow tip shape. Thus, the first portion (a) extends away from the flap score line portion 155 in a first direction, and the second portion (b) extends away from the flap score line portion 155 in a second direction. Although the first portion (a) and the second portion (b) are illustrated as an arrow tip shape, the first portion (a) and the second portion (b) may be arranged in any configuration where stress will be shifted away from the uncut portion 153, such that an uncut portion 153 does not fracture, break or otherwise rupture before desired.

In some embodiments, the first cross-cut 151*a* and the second cross-cut 151*b* may be spaced apart so as to define the uncut portion 153 of the flap score line portion 155 therebetween. In some embodiments, the uncut portion 153, extends between 0.5-2.5 in, between 0.75-2.0 in, or between 1-1.5 in. In some embodiments, the uncut portion 153 is configured to retain two adjacent flaps (e.g., the first flap 123 and the second flap 125 FIG. 2B) of the plurality of flaps 120 in an open position (see e.g., 533, FIG. 6A) after the box blank 100 is formed into a box. In some embodiments, the uncut portion 153 may be positioned closer to the fourth outer edge 100*d* of the box blank 100, while in other embodiments the uncut portion 153 may be positioned closer to the junction score line 107. In some embodiments, the uncut portion 153 may be centered between the first cut 152*a* and the second cut 152*b*. In some embodiments, the length of the uncut portion 153 may be equal to the length of the first cut 152*a*, while in other embodiments, the length of the uncut portion 153 may be greater than the length of the first cut 152*a*.

In some embodiments, the second cut 152*b* may comprise a tail end 154 extending therefrom. In some embodiments, the tail end 154 may cross the juncture score line 107 into one of the plurality of panels 110, such as illustrated in FIG. 3A. In some embodiments, the tail end 154 may be shaped to relieve stress from the box blank during formation into a box, such as to provide relief points and foldable positions. In some embodiments, the tail end 154 may be configured as a line of weakness, a series of perforations, and/or a through cut. In some embodiments, the tail end 154 may be parallel to the juncture score line 107, such as illustrated for example in FIGS. 3B-C, while in other embodiments, the tail end 154 may be formed at an angle between the juncture score line 107 and the panel score line portion 105, such as illustrated for example in FIG. 3D. In some embodiments, the tail end 154 may be formed as a cross-cut of the panel score line portion 105, such as illustrated for example in FIGS. 3B-C, while in other embodiments, the tail end 154 may extend away from the panel score line portion 105, such as illustrated for example in FIGS. 3A and 3D. In some embodiments, the tail end 154 may be configured to minimize continual cutting or tearing. For example, if the second cut 152*b* ended along the panel score line portion 105, it may be more likely during box formation, packaging, and/or traveling, that the panel score line portion 105 may rupture as the second cut 152*b* may bias the panel score line portion 105 towards rupturing.

As mentioned, in some embodiments, the box blank may comprise a panel pattern cut 140 extending across the panel score line portion 105, and within adjacent panels of the plurality of panels 110. The panel pattern cut 140 illustrated in FIGS. 4A-C may comprise different cut portions and shapes within the panel pattern cut 140. In some embodiments, the panel pattern cut 140 may include a first panel score line cross-cut 141*a* and a second panel score line cross-cut 141*b*. Each of the first panel score line cross-cut 141*a* and the second panel score line cross-cut 141*b* may extend between adjacent panels (see e.g., FIG. 2A). In some embodiments, the first panel score line cross-cut 141*a* and the second panel score line cross-cut 141*b* may be spaced a distance apart. In some embodiments, the distance between the first panel score line cross-cut 141*a* and the second panel score line cross-cut 141*b* may be equal to the length of the uncut portion 153, while in other embodiments the distance between the first panel score line cross-cut 141*a* and the second panel score line cross-cut 141*b* may be larger than the length of the uncut portion 153 or smaller than the length of the uncut portion 153.

In some embodiments, a panel score line cut 143 may extend at least partially between the first panel score line cross-cut 141*a* and the second panel score line cross-cut 141*b*. The panel score line cut 143 may be configured as a series of perforations, a cut, a line of weakness, or other weakness such that the panel score line cut 143, may partially fracture, or at least bend during formation of the box from the box blank. In some embodiments, the panel score line cut 143 may be positioned on the panel score line portion 105, while in other embodiments, the panel score line cut 143 may be spaced apart from the panel score line portion 105.

In some embodiments, at least one panel cut 142 may extend at least partially between the first panel score line cross-cut 141*a* and the second panel score line cross-cut 141*b*. In some embodiments, the at least one panel cut 142 may be configured as a line of weakness rather than a cut. In some embodiments, the at least one panel cut 142 may provide stress relief with the panel pattern cut 140 during formation to allow the corrugate within the panel pattern cut 140 to fold accordingly. As illustrated in FIG. 4A, in some embodiments, the at least one panel cut 142 may extend between the first panel score line cross-cut 141*a* and the second panel score line cross-cut 141*b*, while defining an intact portion 144 extending between the first panel score line cross-cut 141*a* and the at least one panel cut 142, and between the second panel score line cross-cut 141*b* and the at least one panel cut 142. In some embodiments, the intact portion 144 may be sized so as to retain the corrugate within the panel pattern cut 140 within the box blank 100, thereby preventing any scrap corrugate, during die cutting, thus, improving run time.

In some embodiments, such as illustrated in FIG. 4B, the at least one panel cut 142 may extend from one and/or both sides of the first panel score line cross-cut 141*a* and the second panel score line cross-cut 141*b*, such that the intact portion 144 may be positioned in between the at least one panel cuts 142.

In some embodiments, such as illustrated in FIG. 4C, the at least one panel cuts 142 may be spaced apart from the panel score line cut 143, but not parallel to the panel score line cut 143. Thus, in some embodiments, the at least one panel cut 142 may be curved.

In some embodiments, the at least one panel cut 142 is designed to create a weakness within the plurality of panels 110 to allow the panel pattern cut 140 to receive the flap pattern cut 150 therein (e.g., after the box is formed). To explain, when the blank 100 is erected into a box, the panel pattern cut 140 and the flap pattern cut 150 may be configured to align such that the uncut portion 153 of the flap pattern cut 150 aligns with the intact portion 144 of the panel pattern cut 140. Thus, as the box is erected a portion of the panel pattern cut 140 may shift inward (e.g., towards the interior of the box) such that the first panel score line cross-cut 141*a* and the second panel score line cross-cut 141*b* may be exposed and configured to receive at least a portion of the uncut portion 153 of the flap pattern cut 150. Thus, the interaction may be configured to hold the plurality of flaps 120 in an open position to the exterior of the box, when erected, such that the box may be filled without interference, and then the user may rupture the uncut portion 153 to allow the plurality of flaps 120 to be formed into a top side of a box in a closed position. Notably, in some embodiments, the panel pattern cut 140 may not be required to still enable the uncut portion 153 from the flap pattern cut 150 to hold the plurality of flaps 120 in an open position to the exterior of the box, when erected, such that the box may be filled without interference.

Returning to FIG. 2A, in some embodiments, the box blank 100 may comprise two flap pattern cuts 150, separated by at least one flap, such that the flap pattern cuts 150 are not positioned on the same flap. For example, the first edge (see e.g., 120*a* FIG. 1B) and the third edge (see e.g., 120*c* FIG. 1B) of the same section (e.g., 102 FIG. 1B). In the illustrated embodiment, one flap pattern cut 150 may be positioned between the first flap 123 and the second flap 125 and a second flap pattern cut 150 may be positioned between the third flap 127 and the connector tab 119. Alternatively, in some embodiments, one flap pattern cut 150 may be positioned between the fourth flap 121 and the first flap 123, and one flap pattern cut 150 may be positioned between the second flap 125 and the third flap 125.

In some embodiments, the panel pattern cut 140 may be formed between sections (e.g., 102) of the box blank comprising the flap pattern cut 150. To explain, at least one of the flap pattern cuts 150 may be formed between the first flap 123 and the second flap 125. Thus, for a flap pattern cut to be formed between the same sections (e.g., first section and second section), the panel pattern cut 140 is formed about the panel score line portion between the first panel 113 and the second panel 115. Alternatively, in some embodiments, the box blank 100 may comprise no panel pattern cuts 140 and may comprise only the flap pattern cuts 150 and the flap score line cuts 157.

Example Processes

Embodiments of the present invention provide processes and systems for forming a corrugated box blank, and in some embodiments for forming the corrugated box blank into a box, according to various embodiments described herein. In this regard, associated system and method for manufacturing, shipping, and forming example box blanks and converting into corresponding shipping boxes described herein are contemplated by some embodiments of the present invention. Such systems and methods may include various machines and devices, including for example box forming devices (e.g., for folding, gluing, and/or taping boxes, among other things), die cutters, and/or corrugators. In this regard, known corrugators utilize web product (e.g., liner) and flute medium to form corrugated web product (which may be formed into any number of layered corrugate, such as conventional corrugate (liner, flute medium, liner) or double-walled corrugate (liner, flute medium, liner, flute medium, and liner)). The formed corrugated web product may then be scored and/or cut (e.g., sliced, perforated, etc.) as needed to form a box blank of the desired box (e.g., any of the box designs described herein).

Various examples of the steps performed in accordance with some embodiments of the present invention will now be provided with reference to FIG. 5A-D. In this regard, FIG. 5A illustrates a process flow diagram according to an example method for cutting a box blank and forming the box blank into a box according to an example embodiment 800.

In some embodiments, a corrugated sheet 200 may be formed within a corrugator 600 or similar machine that processes corrugate web product into desired products, such as box blanks. As illustrated, the corrugator may include a die cutting press 300. In some embodiments, the die cutting press 300 may be separate from the corrugator. Further, while a sheet (e.g., a cut portion of the web) is shown entering the die cutting press 300, in some embodiments, corrugate web may enter the die cutting press 300 and the box blanks may be cut and formed into sheets thereafter.

The corrugated sheet 200 may be positioned with a leading edge 200*d* (e.g., the fourth outer edge 100*d* FIG. 1A) configured to enter into a die cutting press 300. The corrugated sheet 200, illustrated in FIG. 5B, may define the leading edge 200*d*, a trailing edge 200*b* (e.g., the second outer edge 100*b* FIG. 1A) opposite and parallel to the leading edge 200*d*, a first outer edge 200*a*, and a third outer edge 200*c* parallel to the first outer edge 200*a* and perpendicular to the leading edge 200*d*. In some embodiments, the trailing edge 200*b* may define a plurality of bottom flaps 230, wherein each of the plurality of flaps 230 is separated by a gap 238 preformed in the corrugated sheet 200.

In some embodiments, the third outer edge 200*c* may define a connection flap 219. In some embodiments, the connection flap 219 may extend from the leading edge 200*d* to the trailing edge 200*b*, thereby defining a bottom connection flap portion 219*a*. In some embodiments, the connection flap 219 may not include the bottom connection flap portion 219*a*, rather the third outer side edge 200*c* may be nonlinear between the leading edge 200*d* and the trailing edge 200*b*. In this regard, the length of the leading edge 200*d* may be larger than the length of the trailing edge 200*b*.

Returning to FIG. 5A, the corrugated sheet 200 is positioned such that the leading end 200*d* of the corrugated sheet enters into the die cutting press 300 to be formed into the box blank 100. FIG. 5C illustrates an example die cut 301, separated into two pieces, used to on the die cutting press (e.g., 300 FIG. 5A) to form the box blank 100. In some embodiments, the die cut 301 may include one or more raised portions 304 positioned on a base 303 of the die cut 301 to align the corrugate sheet within the die cut 301. In some embodiments, the die cut 301 may be a cylindrical object which rotates as the corrugated sheet 200 moves through the die cutting press (300 FIG. 5A).

As illustrated, in some embodiments, the base 303 of the die cut 301 may include a series of latitudinal perforations 305, and a series of longitudinal perforations 307, with respect to the cylindrical shape. In some embodiments, the latitudinal perforations 305 may correspond to the section score line (e.g., the panel score line portion 105, FIG. 1 and the flap score line portion 155 FIG. 1), and the longitudinal perforations 307 may correspond to the juncture score line (e.g., 107 FIG. 1), and the bottom score line (e.g., 109 FIG. 1).

In some embodiments, latitudinal perforations 305 may comprise pattern die 350, 340. In some embodiments, a first pattern die 350 may be configured to create the flap pattern cuts (e.g., 150 FIG. 1), and a second pattern die 340 may be configured to create the panel pattern cut (e.g., 140 FIG. 1). In some embodiments, the first pattern die 350 and the second pattern die 340, although illustrated as diamonds, may be configured in an orientation to form the flap pattern cuts 150 illustrated in FIGS. 3A-D, and the panel pattern cuts 140 illustrated in FIGS. 4A-C.

In some embodiments, each of the latitudinal perforations 305, and the longitudinal perforations 307 may comprise cut knives and/or patterns to interact with the corrugate sheet to form the section score line (e.g., the panel score line portion, and the flap score line portion), juncture score line, and bottom score line (e.g., 105, 155, 107, 109 of FIG. 1). In some embodiments, such as illustrated in FIG. 5D, the box blank 100 may be formed after the sheet of corrugate 200 exits the die cutting press 300.

In some embodiments, the die cutting press 300 may run up to 250 revolutions a minute, up to 300 revolutions a minute, 350 revolutions a minute or even up to 400 revolutions a minute. In some embodiments, the die cut may be formed such that both a first half and second half of the roller each define the necessary features to form a box blank as desired—thereby allowing 2-UP box blank formation. In some embodiments, the die cutting press 300 may run two sheets of corrugate 200 at a time. In some embodiments, the die cutting press 300 may run up to 1 million sheets of corrugate before changed, up to 1.5 million sheets of corrugate before being changes, or even up to 2 million sheets of corrugate before being changed.

In contrast to other die cuts for corrugate which may routinely create scrap and cause scrap to be maintained on the die, and/or in the blank, the present die cut 301 does not create cut-outs, and thus, does not create scrap corrugate. As such the die cut 301 may not need to use pins to remove scrap, and in turn may not be clogged as easily from the scrap not being removed. To explain some current machines require placement of pins to help in removal of scrap during cutting. However, at some desired throughput speeds, such a solution is impractical and scraps are often dropped into the machinery, which can create issues that need to be resolved—thereby negatively affecting down time.

Returning to FIG. 5A, in some embodiments, the box blank 100 may be piled and packaged to be sent to the customer, where the boxes may be assembled on site by the customer. In other embodiments the box blank 100 may be erected into a box 500 via a box erector 400. In some embodiments, the flap score line cut (e.g., 157 FIG. 1) may be formed by the box erector 400, while in other embodiments, as discussed above, the score lines may be formed by the die cut 301. As illustrated in FIG. 5D, to form the box 500 shown in FIGS. 6A-B, the connector tab 119 may be attached, such as using an adhesive (although additional or alternative attachment means can be utilized, such as tape, staples, etc.) to the fourth panel 111, and in some embodiments, to the fourth flap 121. In some embodiments, the plurality of flaps 120 may be folded towards an exterior of the plurality of panels 110, and the plurality of bottom flaps 130 may be folded towards an interior of the box and attached to one another. In some embodiments, the fourth bottom flap 131 may be attached to both the first bottom flap 133 and the third bottom flap 137, and the second bottom flap 135 may be attached to both the first bottom flap 133 and the third bottom flap 137. In this regard, in some embodiments, the fourth bottom flap 131 and the second bottom flap 135 may be folded inward, and the first bottom flap 133 and the third bottom flap 137 may be folded in second, such that an interior surface of the first bottom flap 133 and third bottom flap 137 may be attached to an exterior surface of the fourth bottom flap 131 and the second bottom flap 135.

The operations illustrated in and described with respect to FIGS. 5A-D may, for example, be performed by, with the assistance of, and/or under the control of one or more of a user or a machine for performing the operation (e.g., a corrugator for forming the corrugated blanks, a die cutting press for forming the box blank, a box maker for forming the box or portions thereof, etc.).

Example Box

FIGS. 6A-B illustrate an example formed box 500. FIG. 6A illustrates a perspective view of the example box 500. The box 500 may comprise a plurality of walls 510, a plurality of flaps 520, and a bottom surface 530.

In some embodiments, a connector tab 519 may be attached to one of the plurality of walls 510 to retain the box shape of the box 500. Similarly, the bottom surface 530 may comprise a plurality of attached bottom flaps (e.g., 130 FIG. 1). In some embodiments, the plurality of flaps 520 may be folded to the outside of the box 500 along a juncture score line 507 thereby defining an opening 570 of the box 500. In this regard, the plurality of flaps 520 may be folded such that the plurality of flaps contact an exterior surface 510*a* of the plurality of walls 510.

In some embodiments, the plurality of flaps 520 may maintain position on the exterior of the box 500 through a flap pattern cut 550. To explain, a first flap pattern cut 550 and a second flap pattern cut 550 may be configured in catty corner to one another (e.g., diagonal corners of the box 500), thus, each of the flap pattern cuts 550 may be configured to hold two of the plurality of flaps 520 against the exterior surface 510*a* of the plurality of walls 510.

In some embodiments, the flap pattern cut 550 comprises a first cut 552*a* and a second cut 552*b*, the first cut 552*a* extending from a leading edge 500*d* of the plurality of flaps 520 to a first cross-cut 551*a*, and the second cut 552*b* extending from a second cross-cut 551*b* through the juncture score line 507. In the illustrated embodiment, the first cross-cut 551*a* and the second cross-cut 552*b* define an uncut portion 553 therebetween.

In some embodiments, the flex of the corrugate material within the plurality of flaps 520 may cause the plurality of flaps 520 to be biased slightly off of the exterior surface 510*a* of the plurality of walls 510. Thus, the first cross-cut 551*a* and the second cross-cut 522*b* help with retention of the uncut portion 553 (e.g., in a flap pattern cut on a flap score line between the underneath walls) such that two adjacent flaps of the plurality of flaps 520 remain in an open position, wherein, in the open position, the plurality of flaps 520 are adjacent and/or near the exterior surface 510*a* of the plurality of walls 510.

FIG. 6B illustrates an interior perspective of the box 500. In some embodiments, each of the flap pattern cuts 550 comprise a tail portion 554. In some embodiments, the tail portion 554 (e.g., 154 FIG. 3) may extend into the adjacent one of the plurality of walls 510. Thus, the tail portion 554 may be configured to prevent the second parallel cut 522*b* from continuing into a panel score line 505 between one of the plurality of walls 510 and the connection flap 519.

In some embodiments, the panel score line 505 between the plurality of walls 510 may comprise a panel pattern cut 540. In some embodiments, the panel pattern cut 540 may be configured as the panel pattern cut 140 (shown in FIGS. 4A-C). In some embodiments, the panel pattern cut 540 may comprise a first panel score line cross-cut 541*a* and a second panel score line cross-cut 541*b*. In some embodiments, the panel pattern cut 540 may comprise a line of weakness 543 (e.g., the panel score line cut 143 FIGS. 4A-C) extending between the first panel score line cross-cut 541*a* and the second panel score line cross-cut 541*b*. In some embodiments, the line of weakness 543 may be configured to cause a portion of the corrugate to collapse into itself when the box 500 is erected. In some embodiments, the panel pattern cut 540 may further comprise a first panel cut 542*a* and a second panel cut 542*b* each spaced apart from the line of weakness 543. In some embodiments, the panel pattern cut 540 may be formed as illustrated in one of FIGS. 4A-C. In some embodiments, the line of weakness 543 allows the box 500 to be erected easier. For example the line of weakness forces the box to have a weak spot to collapse into when erected.

Example Flowchart(s)

Various examples of the operations performed in accordance with some embodiments of the present invention will now be provided with reference to FIG. 7. In this regard, FIG. 7 illustrates a flowchart according to an example method for forming a box blank and forming a box therefrom according to an example embodiment 700. The operations illustrated in and described with respect to FIG. 7 may, for example, be performed by, with the assistance of, and/or under the control of one or more of a user or a machine for performing the operation (e.g., a corrugator for forming the corrugated box blanks, a die cut for scoring and cutting the corrugated box blanks, a box maker for forming the box or portions thereof, etc.).

Operation 710 may comprise forming a box blank, and operation 720 may comprise running the box blank through a die cutting press to form the box blank with appropriate scores and cuts, such as described herein.

Operation 730 may comprise providing the box blank to a box maker to assemble the box (although box formation may, in some embodiments, occur manually).

Then, such as upon arrival at the final destination, operation 740 may comprise filling the box with goods, and operation 750 may optionally comprise breaking the uncut portion to attach the plurality of flaps to one another to close the box. This may be performed using a machine/device and/or via a user.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A box blank for a corrugated box, the box blank comprising:

a plurality of panels including at least a first panel and a second panel, wherein the first panel defines a first edge, a second edge, a third edge, and a fourth edge, wherein the second panel defines a first edge, a second edge, a third edge, and a fourth edge, wherein the third edge of the first panel is connected to the first edge of the second panel along a panel score line portion, wherein the panel score line portion is foldable;

a plurality of flaps including at least a first flap and a second flap, wherein the first flap defines a first edge, a second edge, a third edge, and a fourth edge, wherein the second flap defines a first edge, a second edge, a third edge, and a fourth edge, wherein the second edge of the first flap is connected to the fourth edge of the first panel, wherein the second edge of the second flap is connected to the fourth edge of the second panel, wherein the third edge of first flap is connected to the first edge of the second flap along a flap score line portion, wherein the flap score line portion is foldable;

a first cross-cut extending across the flap score line portion between the first flap and the second flap;

a second cross-cut extending across the flap score line portion between the first flap and the second flap, wherein the second cross-cut is spaced apart from the first cross cut so as to define an uncut portion of the flap score line portion therebetween;

a first cut extending from the first cross-cut at least a portion of a first distance leading to the fourth edge of the first flap or the fourth edge of the second flap; and a second cut extending from the second cross-cut at least a portion of a second distance leading to the second edge of the first flap or the second edge of the second flap.

2. The box blank of claim 1, wherein the second cut comprises a tail portion and the tail portion extends beyond the fourth edge of either the first panel or the second panel.

3. The box blank of claim 2, wherein the tail portion extends away from the panel score line portion.

4. The box blank of claim 1, wherein the first cut extends to the fourth edge of the first flap or the fourth edge of the second flap.

5. The box blank of claim 1, wherein the uncut portion is between 1-1.5 inches.

6. The box blank of claim 1, wherein the flap score line portion is a line of weakness.

7. The box blank of claim 1, wherein the second cut is parallel to the flap score line portion.

8. The box blank of claim 1, wherein the first cut is on the flap score line portion.

9. The box blank of claim 1, wherein the first cross-cut and the second cross-cut extend non-linearly across the flap score line portion.

10. The box blank of claim 1, wherein the first cross-cut or the second cross-cut comprises a first portion extending in a first direction from the flap score line portion and a second portion extending in a second direction from the flap score line portion, wherein the first direction and the second direction are different.

11. The box blank of claim 1, further comprising:

a panel pattern cut about the panel score line portion between the first panel and the second panel, the panel pattern cut comprising:

a first panel score line cross-cut extending across the panel score line portion between the first panel and the second panel; and a second panel score line cross-cut extending across the panel score line portion between the first panel and the second panel, wherein the second panel score line cross-cut is spaced apart a distance from the first panel score line cross-cut.

12. The box blank of claim 11, wherein the panel pattern cut further comprises:

at least one panel cut or line of weakness extending at least partially between the first panel cross-cut and the second panel cross-cut, wherein the at least one panel cut or line of weakness is spaced apart from the panel score line portion between the first panel and the second panel.

13. The box blank of claim 11, wherein a length of the uncut portion is smaller than the distance between the first panel score line cross-cut and the second panel score line cross-cut.

14. The box blank of claim 1, further comprising a plurality of bottom flaps, including at least a first bottom flap and a second bottom flap, wherein the first bottom flap defines a first edge, a second edge, a third edge, and a fourth edge, wherein the second bottom flap defines a first edge, a second edge, a third edge, and a fourth edge, wherein the fourth edge of the first bottom flap is connected to the second edge of the first panel, wherein the fourth edge of the second bottom flap is connected to the second edge of the second panel, and wherein the third edge of the first bottom flap is spaced apart from the first edge of the second bottom flap.

15. The box blank of claim 14, wherein the first bottom flap and the second bottom flap are foldable about a bottom score line, wherein the bottom score line abuts the fourth edge of the first bottom flap and the fourth edge of the second bottom flap and the second edge of the first panel and the second edge of the second panel.

16. The box blank of claim 1, wherein the plurality of panels further comprises a third panel and a fourth panel, wherein the third panel defines a first edge, a second edge, a third edge, and a fourth edge, wherein the first edge of the third panel is connected to the third edge of the second panel along a second panel score line portion, wherein the fourth panel defines a first edge, a second edge, a third edge, and a fourth edge, wherein the third edge of the fourth panel is connected to the first edge of the first panel along a third panel score line portion; and wherein the plurality of flaps further comprises a third flap and a fourth flap, wherein the third flap defines a first edge, a second edge, a third edge, and a fourth edge, wherein the fourth flap defines a first edge, a second edge, a third edge, and a fourth edge, wherein the second edge of the third flap is connected to the fourth edge of the third panel, wherein the second edge of the fourth flap is connected to the fourth edge of the fourth panel, wherein the first edge of the third flap is connected to the third edge of the second flap along a second flap score line portion, wherein the second flap score line portion is foldable, wherein the first edge of first flap is connected to the third edge of the fourth flap along a third flap score line portion, wherein the third flap score line portion is foldable.

17. The box blank of claim 16 further comprising:

a connector tab comprising a connector panel and a connector flap, wherein the connector panel is connected to either the third side of the third panel or the first side of the fourth panel along a fourth panel score line portion, and the connector flap is connected to either the third side of the third flap or the first side of the fourth flap along a fourth flap score line portion;

a third cross-cut extending across the fourth flap score line portion;

a fourth cross-cut extending across the fourth flap score line portion, wherein the fourth cross-cut is spaced apart from the third cross-cut so as to define a second uncut portion of the fourth flap score line portion therebetween;

a third cut extending from the third cross-cut at least a portion of a first distance leading to the fourth edge of the third flap or the fourth edge of the fourth flap; and a fourth cut extending from the fourth cross-cut at least a portion of a second distance leading to the second edge of the third flap or the second edge of the fourth flap.

18. The box blank of claim 16, further comprising a third bottom flap and a fourth bottom flap, wherein the third bottom flap defines a first edge, a second edge, a third edge, and a fourth edge, wherein the fourth bottom flap defines a first edge, a second edge, a third edge, and a fourth edge, wherein the fourth edge of the third bottom flap is connected to the second edge of the third panel, wherein the fourth edge of the fourth bottom flap is connected to the second edge of the fourth panel, wherein the first edge of the third bottom flap is spaced apart from the third edge of the second bottom flap, and wherein the third edge of the third bottom flap is spaced apart from the first edge of the second bottom flap.

19. A method of forming a box, the method comprising:

providing a blank, the blank comprising:

a sheet of corrugate defining a first outer edge, a second outer edge, a third outer edge and a fourth outer edge, wherein the fourth outer edge is parallel to the second outer edge, wherein the fourth outer edge is perpendicular to the first outer edge, wherein the first outer edge is parallel to the third outer edge;

running the blank through a blank die to form a box blank, the box blank comprising:

a plurality of panels adjacent the plurality of bottom flaps, wherein the plurality of panels includes at least a first panel and a second panel, wherein the first panel defines a first edge, a second edge, a third edge, and a fourth edge, wherein the second panel defines a first edge, a second edge, a third edge, and a fourth edge, wherein the third edge of the first panel is connected to the first edge of the second panel along a panel score line portion, wherein the panel score line portion is foldable;

a plurality of flaps including at least a first flap and a second flap, wherein the first flap defines a first edge, a second edge, a third edge, and a fourth edge, wherein the second flap defines a first edge, a second edge, a third edge, and a fourth edge, wherein the second edge of the first flap is connected to the fourth edge of the first panel, wherein the second edge of the second flap is connected to the fourth edge of the second panel, wherein the third edge of first flap is connected to the first edge of the second flap along a flap score line portion, wherein the flap score line portion is foldable;

a connection tab extending from one of the plurality of panels and a corresponding one of the plurality of flaps, wherein the connection tab is defined by a connection tab score line portion;

a first cross-cut extending across the flap score line portion between the first flap and the second flap;

a second cross-cut extending across the flap score line portion between the first flap and the second flap, wherein the second cross-cut is spaced apart from the first cross-cut so as to define an uncut portion of the flap score line portion therebetween;

a first cut extending from the first cross-cut at least a portion of a first distance leading to the fourth edge of the first flap or the fourth edge of the second flap; and a second cut extending from the second cross-cut at least a portion of a second distance leading to the second edge of the first flap or the second edge of the second flap; providing the box blank to a box maker, wherein the box maker is configured to:

fold the plurality of flaps such that an outer surface of the plurality of flaps abuts an outer surface of the plurality of panels;

fold the plurality of panels along the plurality of panel score line portions;

adhere the connection tab to one of the plurality of panels and the corresponding one of the plurality of flaps; and adhere the plurality bottom flaps to form a bottom surface.

20. The method of claim 19, wherein the blank die is configured to penetrate a thickness of the blank without removing material from the blank.

21. A box formed from a corrugated box blank, the box comprising:

a plurality of walls, including at least a first wall, a second wall, a third wall, and a fourth wall, wherein each wall is connected to the adjacent wall at a foldable score line portion;

a plurality of flaps, including at least a first flap, a second flap, a third flap and a fourth flap, wherein each of the plurality of flaps extend from the corresponding wall of the plurality of walls, wherein each of the plurality of flaps are folded such that at least a portion of an outer surface of the plurality of walls abuts at least a portion of an outer surface of the plurality of flaps, wherein the plurality of flaps comprise a first uncut portion between the first flap and a second flap and a second uncut portion between the third flap and the fourth flap;

a plurality of bottom flaps, wherein the plurality of bottom flaps extend from the plurality of walls opposite the plurality of walls, wherein the plurality of bottom flaps are adhered to form a bottom, wherein the bottom is perpendicular to the plurality of walls; and a connector tab extending from either the first wall and first flap or the fourth wall and the fourth flap, wherein the connector tab is adhered to either the first wall and first flap or the fourth wall and the fourth flap.

* * * * *